US005842850A

United States Patent [19]

Pappas

[11] Patent Number: 5,842,850

[45] Date of Patent: Dec. 1, 1998

[54] ANTI-FLASH WICK SUSTAINER AND PEDESTAL

[75] Inventor: George G. Pappas, Norwich, Ohio

[73] Assignee: Lumi-Lite Candle Company, Inc., Norwich, Ohio

[21] Appl. No.: 833,784

[22] Filed: Apr. 9, 1997

[51] Int. Cl.[6] ..... F23D 3/16

[52] U.S. Cl. ..... 431/291; 431/323; 431/120

[58] Field of Search ..... 431/291, 73, 197, 431/204, 315, 220, 221, 222, 120, 323

[56] References Cited

U.S. PATENT DOCUMENTS

| | | | |
|---|---|---|---|
| 664,246 | 12/1900 | Ellis . | |
| 1,660,760 | 2/1928 | Murphy | 362/806 X |
| 1,867,420 | 7/1932 | Root . | |
| 2,481,019 | 9/1949 | Joyce | 431/126 |
| 3,036,452 | 5/1962 | Renwick, Sr. et al. | 431/125 X |
| 3,183,688 | 5/1965 | Sobelson | 431/126 X |
| 3,236,072 | 2/1966 | Goldszmid | 431/125 X |
| 3,286,492 | 11/1966 | Frazier, Jr. | 431/126 |
| 3,744,957 | 7/1973 | Wright, Sr. . | |
| 3,910,753 | 10/1975 | Lee | 431/290 |
| 4,013,397 | 3/1977 | Neugart . | |
| 4,332,548 | 6/1982 | Linton et al. . | |
| 4,494,926 | 1/1985 | Riha | 431/321 |
| 4,878,832 | 11/1989 | Lynch | 431/120 |
| 5,193,994 | 3/1993 | Schirneker . | |

*Primary Examiner*—Larry Jones
*Attorney, Agent, or Firm*—Frank H. Foster; Kremblas, Foster, Millard & Pollick

[57] ABSTRACT

An anti-flash wick support for candles having a candle floor. A candle floor includes the bottom surface of a container and the lowest extremity of a freestanding candle. A wick sustainer having a central bore is adhered to the candle floor by an adhesive plug which plugs the bore near the base of the upright column of the wick sustainer. The wick extends downwardly into the bore and the adhesive plug prevents fuel from being drawn upwardly by the wick through the bore to a flame. The flame goes out once the fuel, such as molten wax descends below the top end of the wick sustainer. In an alternative embodiment, a pedestal extends upwardly from, and attaches to, the container floor. A wick sustainer rests upon the fuel impervious top surface of the pedestal.

19 Claims, 5 Drawing Sheets

ANTI-FLASH WICK SUSTAINER AND PEDESTAL

TECHNICAL FIELD

The invention relates to candles, and more specifically to a support for a candle wick which makes the flame go out before the fuel exceeds its flashpoint and all of the candle fuel is consumed.

BACKGROUND ART

Candle wicks function by capillary action drawing a fuel, commonly molten wax, from a pool up through the wick to the flame. The capillary action can be through a fabric or thread wick or through a capillary tube. When the candle fuel pool becomes very shallow, it can become hot enough to vaporize and it no longer needs a wick to burn. This phenomenon is called "flash" or "flashover." Once the upper surface of the wax descends nearly to the floor of the container, the shallow pool of wax can be elevated above its flashpoint temperature, typically about 425° F. with conventional, common waxes. During flashover, the temperature within the candle can be elevated to at least 1200° F. This excessive heat can cause glass containers to break, and it can cause metal tins to scorch the paint off the tin sides and char surfaces on which they are resting. With freestanding candles the molten wax pool must not extend through the candle floor, because wax can flow out onto the candle supporting surface. If the wax flows out or the container of a contained candle breaks, supporting or surrounding objects can be ignited.

An additional problem is that carbon balls may form during burning and fall into the wax pool at the bottom of the candle, or the user may allow matches or wick trimmings to fall to the bottom. These foreign objects may aggravate the flashover problem by becoming secondary wicks if they are ignited by the candle flame.

In conventional candles a wick support, such as the sustainer 2 shown in FIG. 1, is often used to provide lateral support to a wick in a candle to hold the wick in place during pouring of the wax or other fuel, and to keep the wick standing upright when the supporting wax around the wick burns very low. The wick is held in a bore formed completely through the sustainer. During burning, molten wax 4 is drawn upwardly through the wick sides initially, and is carried to the flame. As the upper surface of the molten wax 4 descends to near the top end of the sustainer 2, the heat from the flame liquifies the wax all around the sustainer 2. Once this wax is liquified, molten wax 4 can be drawn from beneath the sustainer 2 through the bore and upwardly to the flame. This permits the majority of the wax 4 to be consumed before the flame goes out from lack of fuel. When the depth of the molten wax 4 is sufficiently small, the flashover problem can occur.

Flashover is a problem which causes significant damage and harm. Therefore, the need exists for an inexpensive and simple safety device for preventing, or decreasing the likelihood of, flashover.

BRIEF DISCLOSURE OF INVENTION

An object of the invention is to keep the source of candle ignition sufficiently above the floor of a container or bottom of a freestanding candle, and to simultaneously prevent candle fuel from being drawn from the reservoir pool once the depth of the fuel falls below a predetermined level. This maintains a thick reservoir of fuel in the container and keeps the temperature below the flashpoint of most candle fuels. A tall enough sustainer prevents the heat of a freestanding candle flame from melting the solid fuel through the candle floor, thereby preventing the molten fuel from spilling out the bottom. "Candle" is defined as a device which burns a solid or liquid fuel producing a flame which vaporizes the fuel as the fuel is drawn by capillary action to the flame. Examples include solid fuels such as wax, gel, liquid wax or oil candles, polymer fuel candles, oil lamps, and other devices meeting the preceding definition of candle.

The invention can be embodied in an anti-flash wick support for a candle having a candle floor. The support comprises a wick sustainer having an upright neck, preferably a column. The neck has a wick bore which extends from a top end of the neck toward a bottom end of the sustainer. The top end of the neck extends above the floor an amount sufficient to prevent flashover. A fuel impervious closure is mounted to the sustainer at a bottom end of the bore. This closure prevents fuel from being drawn through the bore. Preferably the closure is an adhesive plug adhered to the sustainer and extending across the bore, and most preferably also adhering to the candle floor.

Separate from, or in combination with, a sealed sustainer, the invention may be embodied in an anti-flash container for housing a candle. The container comprises a first floor joined to a side wall at a peripheral first floor edge. A pedestal extends upwardly from the first floor and has a fuel impervious second floor surface disposed above the first floor surface. The second floor surface supports a candle wick.

Figure 1:
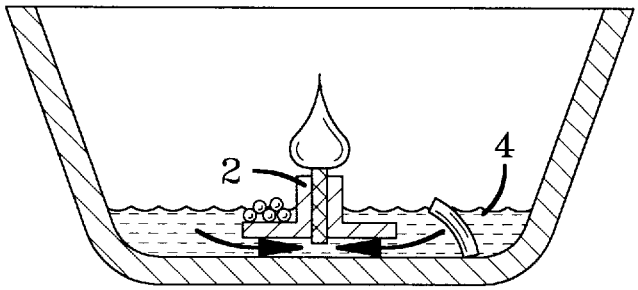
FIG-1 (PRIOR ART)
FIG. 1 is a side view in section illustrating a prior art candle.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

Figure 2:
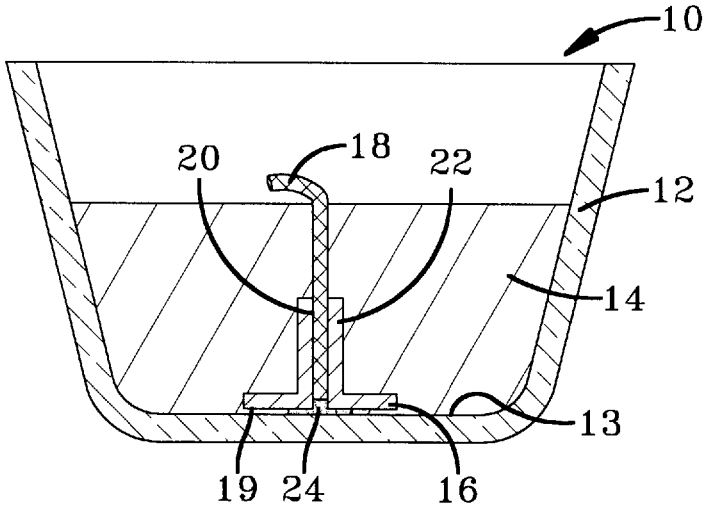
FIG. 2 is a side view in section illustrating a preferred embodiment of the present invention.

The candle 10 of FIG. 2 includes a container 12, a fuel, preferably wax 14 which has been poured into and solidified within the container 12 during manufacture, and a wick 18 mounted to a sustainer 16 at the candle floor. The candle floor is defined as the structure that supports the lowest part of the wax that can become part of the molten wax pool. The candle floor in the candle 10 of FIG. 2 is the container floor 13. The container 12 is a conventional glass jar such as used with container and votive candles, but can be a metal tin or tray.

Figure 7:
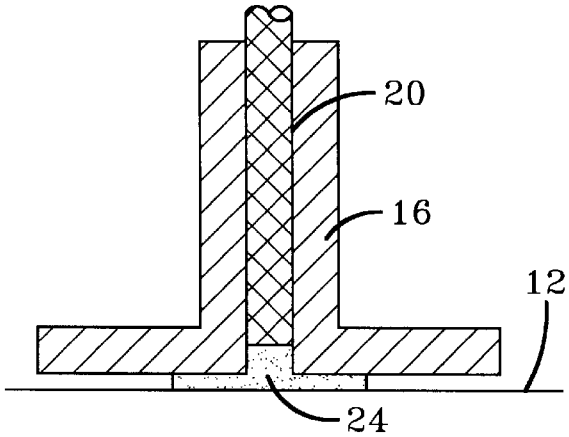
FIG. 7 is a side view in section illustrating the preferred wick sustainer.

The sustainer 16 has an upwardly extending, preferably at least one-half inch tall neck, such as the column 22. The neck is defined as an upright, elongated body, which includes cylinders, cones and parallelepipeds. A cylindrical bore 20 is formed in the sustainer 16 extending from the top end 17 to the bottom end 19 and preferably having a diameter approximately equal to the diameter of the wick 18. The column 22 has an outwardly extending base 23, which is wider than the column 22 to inhibit tipping of the sustainer 16. The sustainer 16 is shown enlarged in FIG. 7.

An adhesive plug 24 is adhered to the bottom end 19 of the base 23, and also to the upwardly facing surface of the floor 13 of the container 12. The plug 24 attaches the sustainer 16 to the floor 13 of the container 12, and functions as a closure to block the bore 20 at its bottom end. The plug 24 is fuel impervious, which is defined as preventing, or significantly restricting, the flow of molten wax and other common candle fuels. The plug 24 prevents or restricts fuel from flowing into the bore 20 where it can be drawn up the wick and burned. The plug 24 therefore serves a dual purpose: blocking fuel from entering the bore 20 from the bottom, and attaching the sustainer 16 to the floor 13. When the sustainer 16 is attached as shown in FIGS. 2, 3, 4 and 6, it also prevents fuel that is being poured into the container 12 during manufacture from displacing the sustainer 16 from its preferred central position, and inhibits tipping of the wick once the hardened wax around it becomes liquified from the heat of burning.

Figure 3:
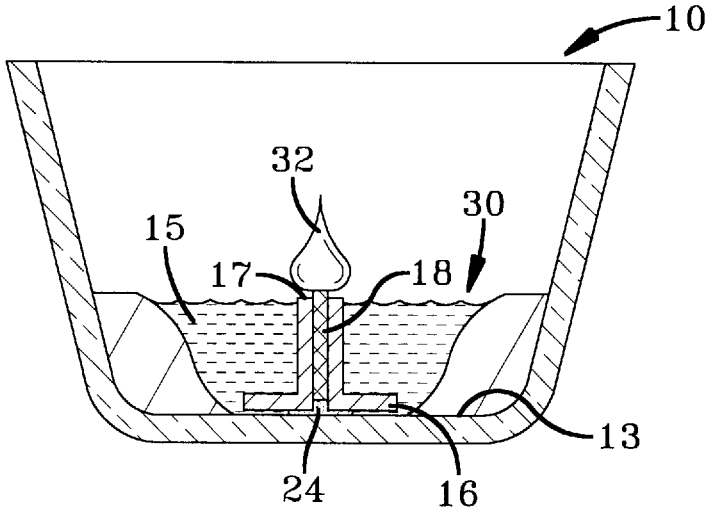
FIG. 3 is a side view in section illustrating the candle of FIG. 2 after significant burning of the candle.
Figure 4:
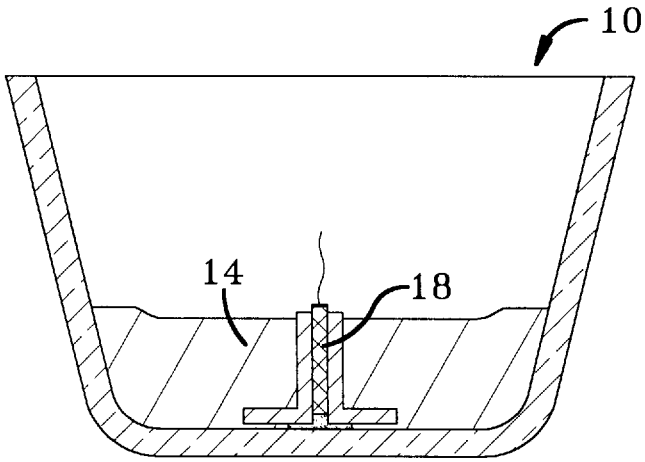
FIG. 4 is a side view in section illustrating the candle of FIGS. 2 and 3 after all available fuel has been consumed.

The candle 10 is shown in FIG. 3 after it has burned for a significant time. The molten wax pool 30 formed around the outside of the sustainer 16 feeds molten wax to the wick 18 as long as its upper surface 15 is at or above the top end 17 of the sustainer 16. The top end 17 of the sustainer 16 is at least approximately one-half inch above the floor 13 of the container 12. Once the upper surface 15 of the wax pool is no longer at or above the top end 17 of the sustainer 16, the wick 18 no longer receives fuel through the sides of the wick 18. Because the adhesive plug 24 prevents the molten wax 30 from being drawn by the wick 18 through the bottom end 19 of the sustainer 16, no fuel is drawn up to the flame and the flame goes out. The candle 10 is shown in FIG. 4 after still further burning. The flame has extinguished due to a lack of fuel, and the molten wax 30 has hardened back into solid wax 14 layer about one-half inch thick.

The preferred sustainer 16 operates in two primary ways to prevent flashover. First, the sustainer 16 has a significant height which, as the wax 14 becomes shallower, keeps the flame far enough above the floor 13 that flashover is inhibited. This sustainer height is preferably at least about one-half inch or greater, but may vary significantly depending upon the type of fuel and its volatility or flashpoint. More volatile fuels may need a taller sustainer to keep the flame higher above the candle floor. Secondly, the sustainer 16 is sealed at the bottom end 19 to prevent, or at least substantially restrict, the flow of fuel through the bore 20 to the flame. This keeps the fuel reservoir from becoming shallow enough for flashover to become more probable than is tolerable. The at least one-half inch tall or taller sustainer ensures that the fuel will not become shallower than about one-half inch, because the flame will go out when it becomes fuel-starved after the top surface of the fuel drops below the one-half inch tall top end. Once the fuel reservoir is shallower than about one-half inch, the likelihood of flashover increases. By preventing the fuel depth from falling below about one-half inch, the likelihood of flashover is significantly reduced.

Figure 5:
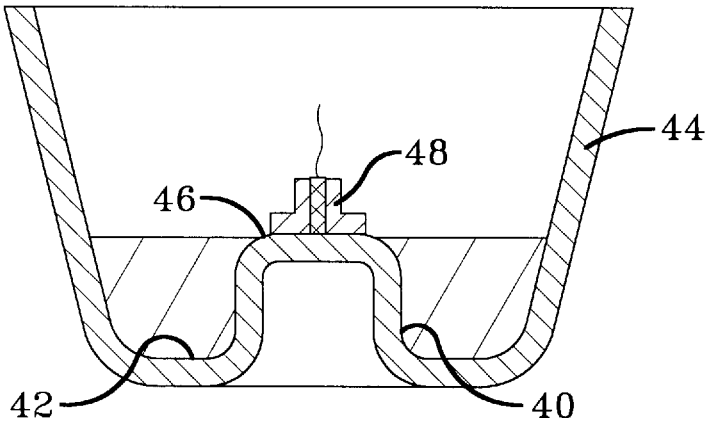
FIG. 5 is a side view in section illustrating an alternative embodiment of the present invention.

Instead of, or in combination with, the preferred sealed sustainer to prevent flashover, an anti-flash pedestal may be mounted to the floor of a container. In FIG. 5, the pedestal 40 is integral with, and extends upwardly from, the floor 42 of the container 44. The container 44 is made of metal, but can alternatively be glass or ceramic. The pedestal 40 has an upper floor 46 which is disposed above the lower floor 42 about one-half to three-quarters of an inch. The upper floor 46 is fuel impervious, and therefore it prevents the flow of fuel into a wick resting on it once the upper surface of the fuel reservoir descends below the upper floor 46. By preventing the fuel from entering the wick, the pedestal 40 starves the candle of fuel and extinguishes the flame.

The pedestal 40 can be formed when the container 44 is initially manufactured. If the container 44 is stamped metal, the pedestal 40 can be stamped into the container 44 during manufacture. If the container 44 is alternatively made of glass, the pedestal 40 can be molded into the container 44. Although it is preferred that the pedestal be integral with the container, a pedestal can be merely attached to an existing container by adhesives, welding, or other known attaching means.

Figure 6:
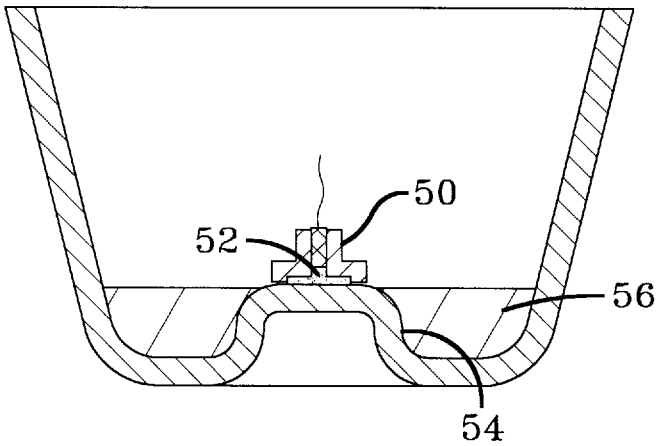
FIG. 6 is a side view in section illustrating another alternative embodiment of the present invention.

When the pedestal 40 has a height of about one-half inch or greater, it can be used in combination with a conventional sustainer 48, as shown in FIG. 5. The conventional sustainer 48 is sufficient because the upper floor 46 of the pedestal 40 is fuel impervious and disposed above the lower floor 42 about one-half inch or greater, which alone will cause the flame to go out before flashover becomes too probable. Therefore, the fuel can be consumed down to the base of the sustainer 48 without the depth of the fuel reservoir becoming shallower than about one-half inch. However, there may be situations in which it is advantageous to use a combination of a sealed sustainer 50 having a fuel impervious closure, such as the adhesive plug 52, and a sealed pedestal 54 as is shown in FIG. 6. The sustainer 50 then functions as in the preferred embodiment to cause the flame to go out when the top surface of the wax 56 falls below the top end of the sustainer 50. When used in combination, the pedestal 54 can be shorter than a pedestal used with an unsealed sustainer. The combined height of the pedestal 54 and sustainer 50 is about one-half inch or greater.

Figure 8:
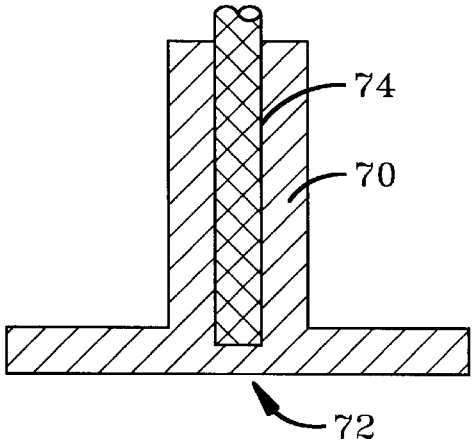
FIG. 8 is a side view in section illustrating an alternative wick sustainer.

An alternative sustainer 70, shown in FIG. 8, has a wall 72 formed at the bottom end of the bore 74. The wall 72 functions as a closure, and can be welded or adhered in position after the bore 74 is formed entirely through the sustainer 70, or the bore 74 can be merely formed partially through the sustainer 70 to leave the wall 72 remaining. The sustainer 70 shown in FIG. 8 is preferred for some candles, such as the freestanding candle 80 shown in FIG. 9. A freestanding candle is defined as a candle having a solid fuel, such as wax, that is not held within a noncombustible container. Freestanding candles do not have to be placed within a container for support, but can be. No container is necessary because, as the fuel is burned, the outer walls of the freestanding candle contain the molten fuel. The freestanding candle 80 shown in FIG. 9 has an at least one-half inch tall sustainer 82, which is essentially identical to the sustainer 70 of FIG. 8. The sustainer 82 is mounted at the candle floor, which for the candle 80 is the surface upon which the bottom of the wax fuel of the candle 80 is resting. This surface can be an attached plate, a container floor, a tray or any horizontal surface. The wick 84 mounts in the sustainer 82, extending upwardly from the bottom end of the bore 86 to the top of the candle 80.

Figure 9:
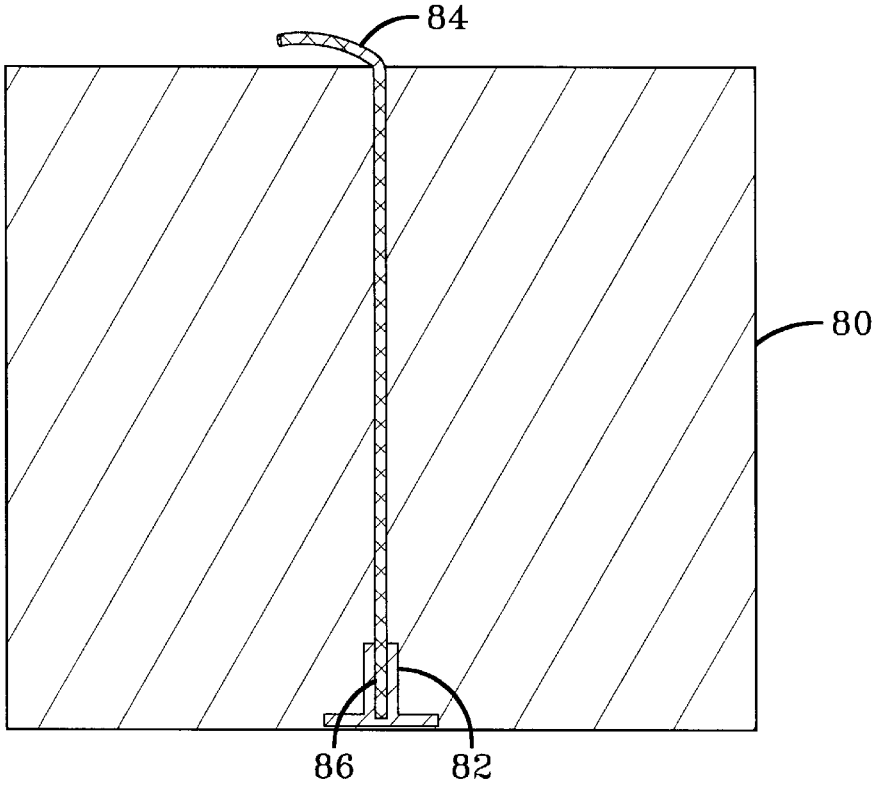
FIG. 9 is a side view in section illustrating a freestanding candle using an alternative embodiment of the present invention.
Figure 10:
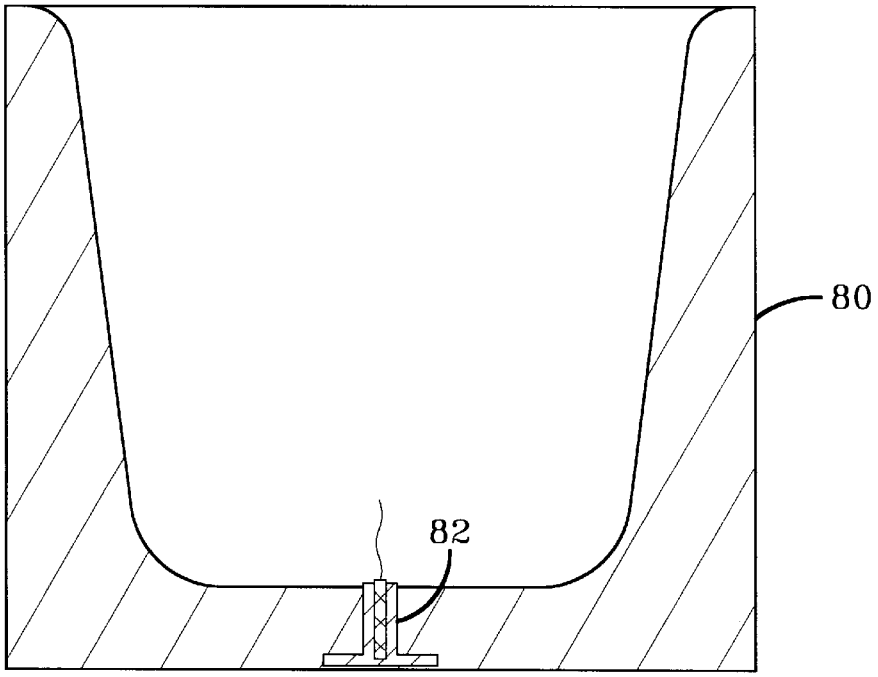
FIG. 10 is a side view in section illustrating the candle of FIG. 9 after significant burning has occurred.

After the candle 80 shown in FIG. 9 has burned for a significant time, it attains the shape shown in FIG. 10. The sidewalls of the candle 80 remained essentially intact as the wick 84 burned downwardly through the center of the candle 80. Since the bottom end of the sustainer 82 is sealed, the flame goes out once the top surface of the fuel descends below the top edge of the sustainer 82.

One danger with freestanding candles is the possibility that the molten pool of fuel will descend to the bottom surface of the candle, and, if the candle is not in a container, the molten fuel will flow onto the candle supporting surface. This danger can be avoided with a sustainer constructed according to the present invention, and with a height large enough to prevent this melt-through problem. Therefore, the sustainer 82 leaves an approximately one-half inch thick reservoir of fuel, preferably wax, and for a freestanding candle a lower portion of this reservoir remains unmelted to prevent the molten wax from flowing out from under the candle 80.

Figure 11:
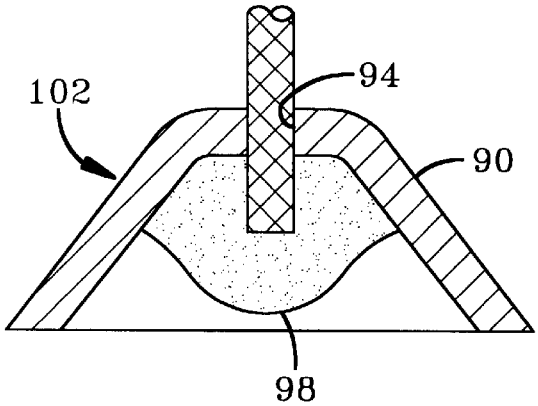
FIG. 11 is a side view in section illustrating an alternative wick sustainer.
Figure 12:
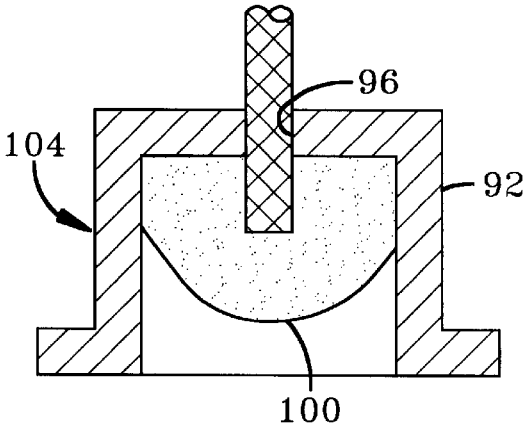
FIG. 12 is a side view in section illustrating an alternative wick sustainer.

Alternative sustainers 90 and 92 are shown in FIGS. 11 and 12. The sustainers 90 and 92 can be used alone or in combination with a pedestal. The sustainers 90 and 92 have central bores 94 and 96, closures 98 and 100, and necks 102 and 104, respectively.

Figure 13:
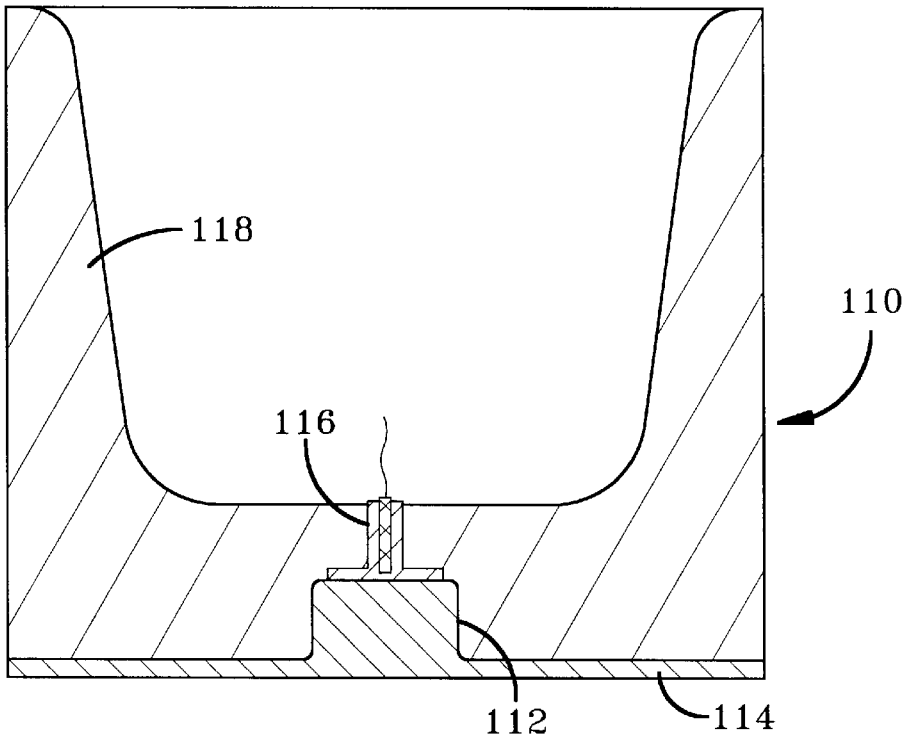
FIG. 13 is a side view in section illustrating a pedestal/sustainer combination in a freestanding candle.

Freestanding candles, such as the candle 80 shown in FIGS. 9 and 10, can also use a pedestal. The pedestal can be used alone or in combination with a sealed sustainer. The candle 110 shown in FIG. 13 has a pedestal 112 attached to a plate 114 mounted to the bottom of the candle 110. The plate 114 with integral pedestal can, for example, be inserted, prior to pouring of the wax, in a mold into which molten wax is poured to form the candle 110. The plate can be made of a noncombustible material or a combustible material, such as wax of the same or a higher melting temperature. The sustainer 116 must be sealed if the top surface of the pedestal 112 is less than about one-half inch above the upper surface of the plate 114, which is the candle floor in this embodiment. The sustainer 116 need not be sealed if the pedestal 112 is one-half inch tall or taller. Alternatively, instead of attaching the pedestal 112 to the bottom of the candle 110 as shown in FIG. 13, the pedestal can be attached to the sidewalls 118 of the candle 110.

Figure 14:
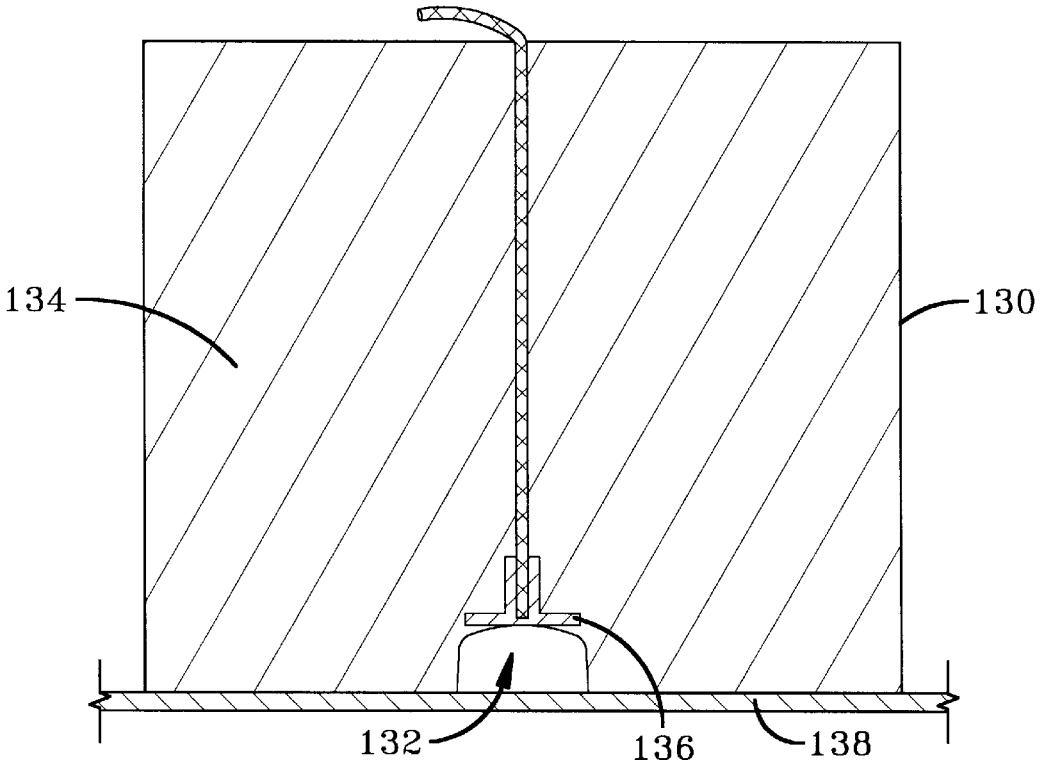
FIG. 14 is a side view in section illustrating an alternative embodiment.

An alternative pedestal structure is shown in FIG. 14. The candle 130 has a concave indentation 132 formed at the bottom of the wax body 134. The sustainer 136, similar to the sustainer 70 of FIG. 8, is held in the wax body 134 by frictional engagement between the outer surface of the sustainer 136 and the wax surrounding the sustainer 136. When the wax surrounding the sustainer 136 melts, the sustainer will fall downwardly into the space formed beneath it, landing on the noncombustible floor 138 and the wax will flow downwardly onto it, extinguishing it. The floor 138 is an attached plate, as illustrated in FIG. 14, but can be substituted by a container floor. If a freestanding candle uses this alternative structure, it must have a floor 138 to prevent the molten fuel which extinguishes the flame from flowing out from under the candle.

While certain preferred embodiments of the present invention have been disclosed in detail, it is to be understood that various modifications may be adopted without departing from the spirit of the invention or scope of the following claims.

It is claimed:

1. An anti flash wick support for a candle having a candle floor, the support comprising:

(a) a wick sustainer having a base wall extending radially outwardly from an upright neck, said neck extending upwardly from the base wall and having a wick bore extending from a top end of the neck toward a bottom end of the sustainer, said top end of the neck extending above the floor an amount sufficient to prevent flashover; and (b) a fuel impervious closure, mounted to the sustainer at a bottom end of the bore, for preventing fuel from being drawn, by capillary action of the wick, through the bore.

2. An anti flash wick support in accordance with claim 1, wherein the closure is an adhesive plug adhered to the sustainer and extending across the bore.

3. An anti flash wick support in accordance with claim 2, wherein the adhesive plug is adhered to the bottom end of the sustainer and the candle floor.

4. An anti flash wick support in accordance with claim 1, wherein the neck is a column extending from a base.

5. An anti flash wick support in accordance with claim 1, wherein the closure is a metal wall extending across the bottom end of the bore.

6. An anti flash wick support in accordance with claim 1, wherein the amount sufficient to prevent flashover is at least about one-half inch.

7. An anti flash container for housing a candle, the container comprising:

(a) a first floor joined to a sidewall at a peripheral first floor edge; and (b) a pedestal extending upwardly from the first floor and having a fuel impervious second floor surface disposed above the first floor surface, said second floor surface supporting a candle wick.

8. A container in accordance with claim 7, wherein the pedestal is integrally attached to the first floor.

9. A container in accordance with claim 7, wherein the pedestal is glass.

10. A container in accordance with claim 7, wherein the pedestal is metal.

11. An anti flash candle comprising:

(a) a candle floor;

(b) a pedestal extending upwardly from the candle floor and having a fuel impervious second floor surface disposed above the candle floor surface;

(c) a wick sustainer mounted upon the pedestal and having an upright neck, said neck having a wick bore extending from a top end of the neck toward a bottom end of the sustainer, said top end of the neck extending above the candle floor an amount sufficient to prevent flashover; and (d) a fuel impervious closure, mounted to the sustainer at a bottom end of the bore, for preventing fuel from being drawn, by capillary action of the wick, through the bore.

12. An anti flash candle in accordance with claim 11, wherein the amount sufficient to prevent flashover is at least about one-half inch.

13. An anti flash candle in accordance with claim 11, wherein the closure is an adhesive plug.

14. An anti-flash candle, comprising:

(a) a sustainer in which a wick is mounted;

(b) a solid fuel body surrounding at least a portion of the sustainer;

(c) a concave indentation formed in the fuel body beneath the sustainer; and (d) a floor beneath the indentation, for enclosing a side of the indentation.

15. An anti flash wick support for a candle having a candle floor, the support comprising:

(a) a wick sustainer having an upright neck, said neck having a wick bore extending from a top end of the neck toward a bottom end of the sustainer, said top end of the neck extending above the floor at least about one-half inch to prevent flashover; and (b) a fuel impervious closure, mounted to the sustainer at a bottom end of the bore, for preventing fuel from being drawn, by capillary action of the wick, through the bore.

16. An anti flash wick support in accordance with claim 15, wherein the closure is an adhesive plug adhered to the sustainer and extending across the bore.

17. An anti flash wick support in accordance with claim 16, wherein the adhesive plug is adhered to the bottom end of the sustainer and the candle floor.

18. An anti flash wick support in accordance with claim 15, wherein the neck is a column extending from a base.

19. An anti flash wick support in accordance with claim 15, wherein the closure is a metal wall extending across the bottom end of the bore.

* * * * *